US007102066B2

(12) United States Patent
Chang

(10) Patent No.: US 7,102,066 B2
(45) Date of Patent: Sep. 5, 2006

(54) ANGLE ADJUST DEVICE FOR A CYMBAL

(75) Inventor: Ming Yi Chang, Taichung (TW)

(73) Assignee: Remarkable Company, Taichung (TW)

( * ) Notice: Subject to any disclaimer, the term of this patent is extended or adjusted under 35 U.S.C. 154(b) by 304 days.

(21) Appl. No.: 10/793,761

(22) Filed: Mar. 8, 2004

(65) Prior Publication Data

US 2005/0211063 A1 Sep. 29, 2005

(51) Int. Cl.
*G10D 13/02* (2006.01)

(52) U.S. Cl. ..... 84/422.1; 84/422.2; 84/422.3

(58) Field of Classification Search ..... 84/422.1–422.3
See application file for complete search history.

(56) References Cited

U.S. PATENT DOCUMENTS 5,052,262 A * 10/1991 Havens ..... 84/421

6,011,209 A * 1/2000 Liao ..... 84/422.3

* cited by examiner

*Primary Examiner*—Kimberly Lockett
(74) *Attorney, Agent, or Firm*—Rosenberg, Klein & Lee

(57) ABSTRACT

An angle adjust device for a cymbal includes a connecting seat mounted to a free end of a cymbal stand. The connecting includes a hollow stub longitudinally extending through the connecting seat and a protrusion laterally extending from the connecting seat. A connector is mounted to the protrusion of the connecting seat and has a trough defined in the connector. The trough has an opening defined in one side of the connector facing the connecting seat. An actuated rod is limited in the connector. The actuated rod has a threaded section screwed into the threaded hole in the slider and a polygonal head co-axially extending from the threaded section through the connector for user to easily rotate the actuated rod and adjust a distance between the slider and the connecting seat.

12 Claims, 7 Drawing Sheets

ANGLE ADJUST DEVICE FOR A CYMBAL

BACKGROUND OF THE INVENTION

1. Field of the Invention

The present invention relates to an angle adjust device, and more particularly to an angle adjust device for a cymbal.

2. Description of Related Art

A conventional angle adjust device (80) for a cymbal in accordance with the prior art shown in FIGS. 6 and 7 is secured on a shaft (71) of a cymbal stand (70). An axle (72) longitudinally upwardly extends from the shaft (71). The axle (72) centrally extends through a first cymbal (73) and a second cymbal (74). The angle adjust device (80) includes a connecting seat (81) mounted on a top of the shaft (71) and the axle (72) extends through the connecting seat (81). An L-shaped actuated rod (82) is pivotally mounted on the connecting seat (81) and a screw (83) extends through the actuated rod and radially screwed into the connecting seat (81). A spring (84) sleeved on the screw (83) between a vertical portion (820) of the actuated rod (82) and the connecting seat (81). The actuated rod (82) has an act portion (821) laterally extending from an upper end of the vertical portion (820) of the actuated rod (82). The actuated rod (82) includes a horizontal portion extending for a top of the vertical portion (820) toward the axle (72). A hollow sleeve (85) extends from the connecting seat (81) and is sleeved on the axle (72). A washer (86), a cushion pad (87) and the second cymbal (73) are respectively sequentially sleeved on the hollow sleeve (85).

The action portion (821) is moved to lift the washer (86) for adjusting an angle of elevation of the cymbal when the actuated rod (82) is rotated to drive the vertical portion (820) moved toward the connecting seat (81).

However, the conventional angle adjust device for a cymbal in accordance with the prior art has the follow disadvantages that need to be advantageously altered.

1. The actuated rod (82), the screw (83) and the spring (84) are assembled after the connecting seat (81) being mounted to the cymbal stand (70). However, the spring (84) is previously compressed between the connecting and the actuated rod (82) so that the conventional angle adjust device is inconveniently assembled.

2. The connecting seat (81) is usually made of metal for providing structure strength to allow the screw screwed into the connecting seat (81). For reducing the friction between the sleeve and the axle (72), the sleeve (85) is usually made of plastic. Consequently, the sleeve (85) needs to be perpendicularly mounted to and extending through the connecting seat. It is a hard job.

3. The actuated rod (82), the screw (83) and the spring (84) of the conventional angle adjust device are exposed so that the conventional angle adjust device for a cymbal does not have the dustproof function.

The present invention has arisen to mitigate and/or obviate the disadvantages of the conventional angle adjust device for a cymbal.

SUMMARY OF THE INVENTION

The main objective of the present invention is to provide an improved angle adjust device for a cymbal, the angle adjust device of the present invention can be easily assembled and has a good connection.

To achieve the objective, the angle adjust device in accordance with the present invention comprises a connecting seat mounted to a free end of a cymbal stand. The connecting includes a hollow stub longitudinally extending through the connecting seat and a protrusion laterally extending from the connecting seat. A connector is mounted to the protrusion of the connecting seat and has a trough defined in the connector. The trough has an opening defined in one side of the connector facing the connecting seat. An actuated rod is limited in the connector. The actuated rod has a threaded section screwed into the threaded hole in the slider and a polygonal head co-axially extending from the threaded section through the connector for user to easily rotate the actuated rod and adjust a distance between the slider and the connecting seat.

Further benefits and advantages of the present invention will become apparent after a careful reading of the detailed description with appropriate reference to the accompanying drawings.

DETAILED DESCRIPTION OF THE INVENTION

Figure 1:
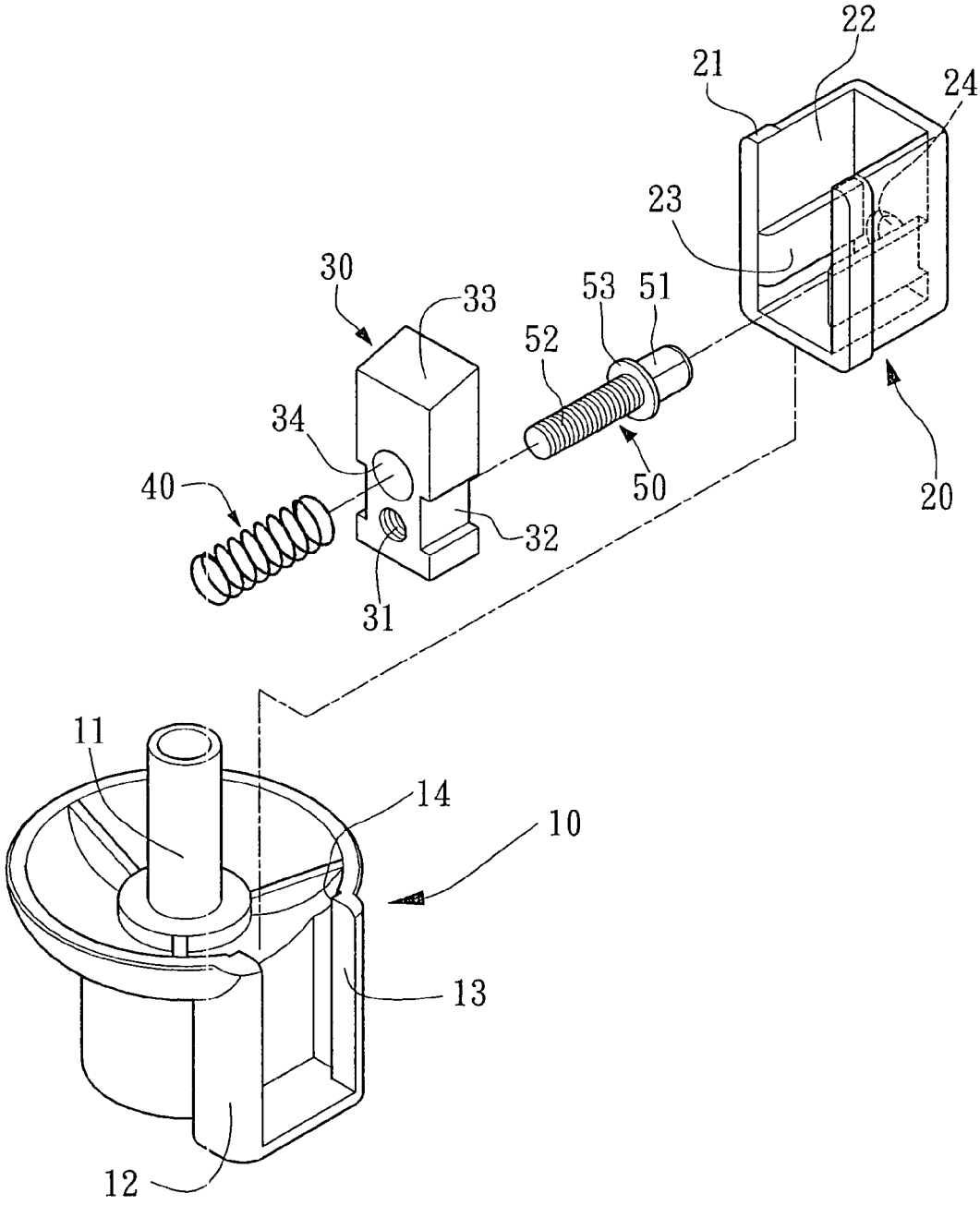
FIG. 1 is an exploded perspective view of an angle adjust device for a cymbal in accordance with the present invention.
Figure 2:
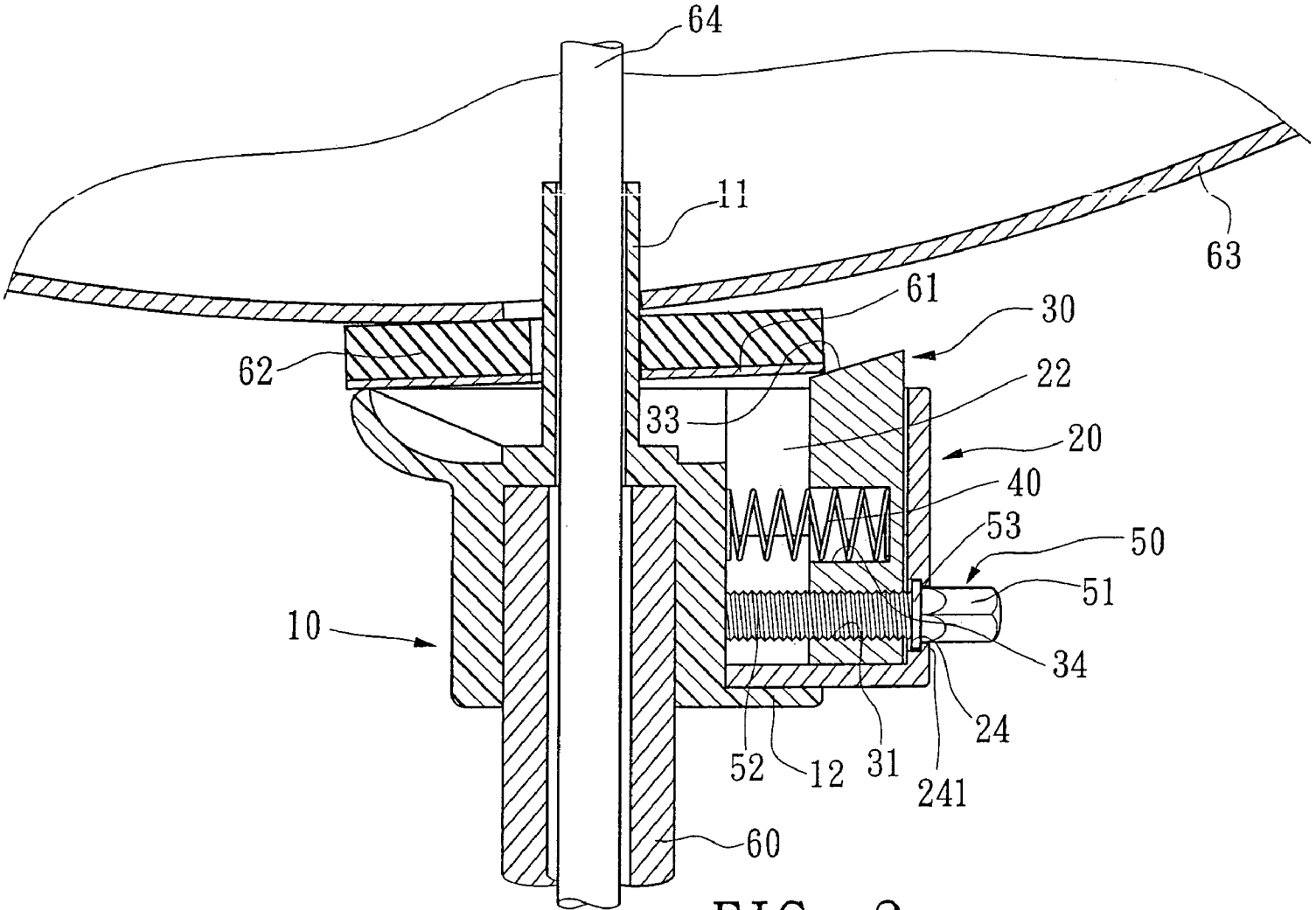
FIG. 2 is a cross-sectional view of the angle adjust device for a cymbal in accordance with the present invention.
Figure 3:
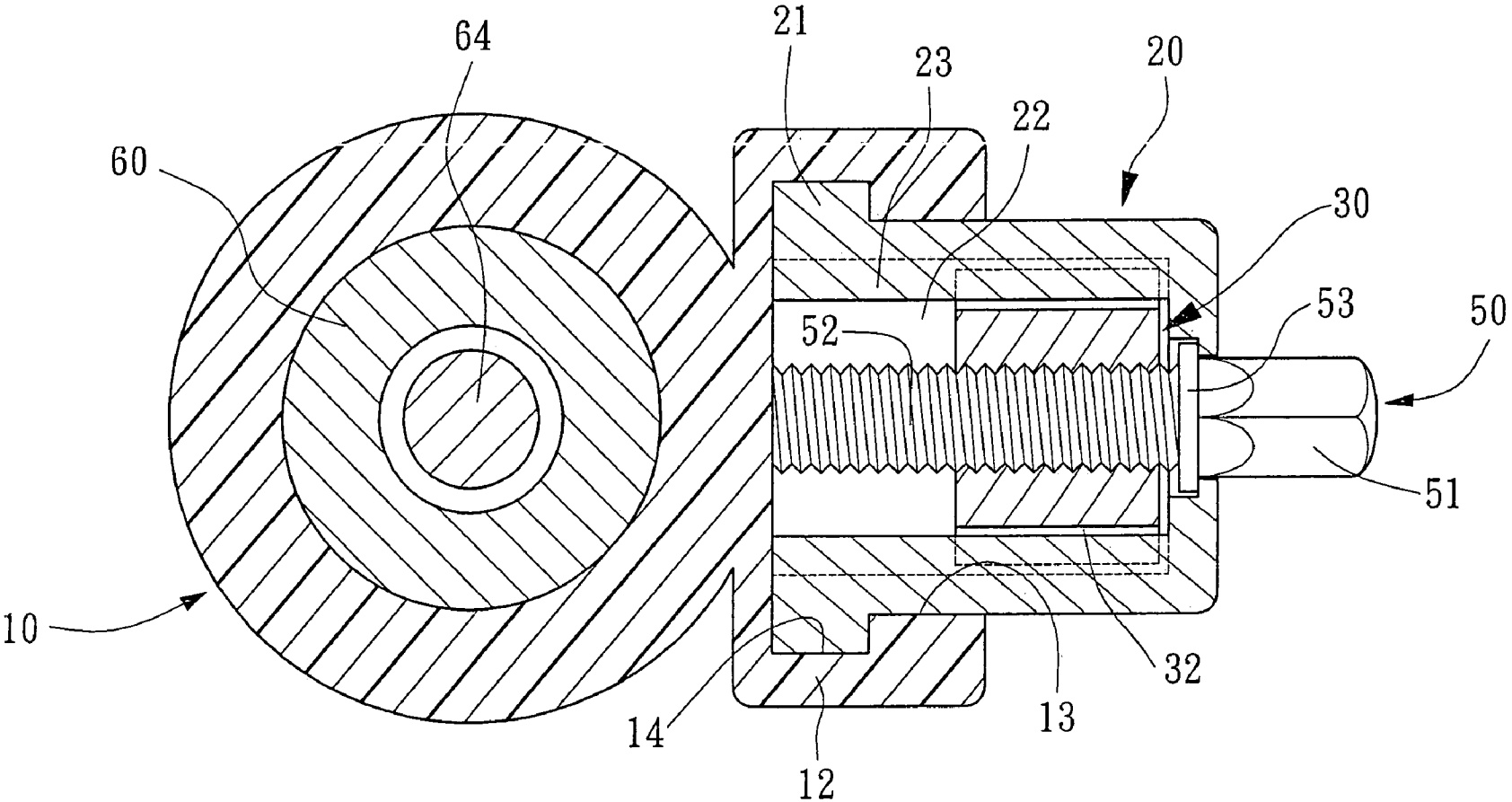
FIG. 3 is a top plan view in cross-section of the angle adjust device in FIG. 2.

Referring to the drawings and initially to FIGS. 1–3, an angle adjust device for a cymbal in accordance with the present invention comprises connecting seat (10) mounted on a free end of a cymbal stand (60), a connector (20) laterally mounted to the connecting seat (10) and a slider (30) movably received in the connector (20).

The connecting seat (10) includes a hollow stub (11) extending therethrough and a U-shaped protrusion (12) laterally extending therefrom. The U-shaped protrusion (12) has two opposite sides each having a rail (13) inwardly extending therefrom near an outer periphery of the connecting seat (10). The two rails (13) correspond to each other to defined two grooves (14) in the two opposite sides of the U-shaped protrusion (12).

The connector (20) is mounted to the U-shaped protrusion (12). The connector (20) includes two flanges (21) respectively laterally extending from two opposite sides of the connector (20). Each flange (21) is received in a corresponding one of the two grooves (14) in the U-shaped protrusion (12) to hold the connector (20) in place on the connecting seat (10). A trough (22) is defined in the connector (20) and two guiders (23) laterally inwardly extend from two opposite sidewalls of the trough (22). The trough (22) has an opening (not numbered) defined in one side of the connector facing the connecting seat (10). A through hole (24) is defined in a back of the connector (20) and horizontally communicates with the trough (22). An annular lip (241) radially extends from an inner periphery of the through hole (24).

The slider (30) includes a threaded hole (31) defined therein and co-axially corresponds to the through hole (24) in the connector (20). The threaded hole (31) extends through the slider (30). Two grooves (32) are defined in two opposite sides of the slider (30) for movably receiving a corresponding one of the two guiders (23). A tapered plane (33) is formed on a top portion of the slider (30). The height of the tapered plane (33) is gradually reduced relative to the distance between the slider (30) and hollow stub (11) of eth connecting seat (10). A blind hole (34) is laterally defined in the slider (30) and extends toward the connecting seat (10). A resilient member (40) is compressively mounted between the slider and the connecting (10). In the preferred embodiment of the present invention, the resilient member (40) is a coil spring. The resilient member (40) is partially received in the blind hole (34), and has a first end abutting against the outer periphery of the connecting seat (10) ad a second end abutting a bottom of the blind hole (34) in the slider (30) for outwardly pushing the slider (30).

An actuated rod (50) includes a threaded section (52) screwed into the threaded holed (31) in the slider (30) for adjusting a distance between the slider (30) and the connecting seat (10) when rotating the actuated rod (50). A shoulder (53) radially outwardly extends from the actuated rod (50) and abuts against the annular lip (241) due to the restitution force of the resilient member (40). A polygonal head (51) centrally extends from the shoulder (53) through the through hole (24) in the connector (20) for user to easily rotate the actuated rod (50). The polygonal head (51) co-axially corresponds to the threaded section (52).

As usual, the cymbal stand (60) has an axle (64) longitudinally extending therefrom through the hollow stub (11) of the connecting seat (10). A washer (61), a cushion pad (62) and a cymbal (63) are sequentially sleeved on the hollow stub, wherein the tapered plane (33) of the slider (30) abuts against a bottom of the washer (61).

Figure 4:
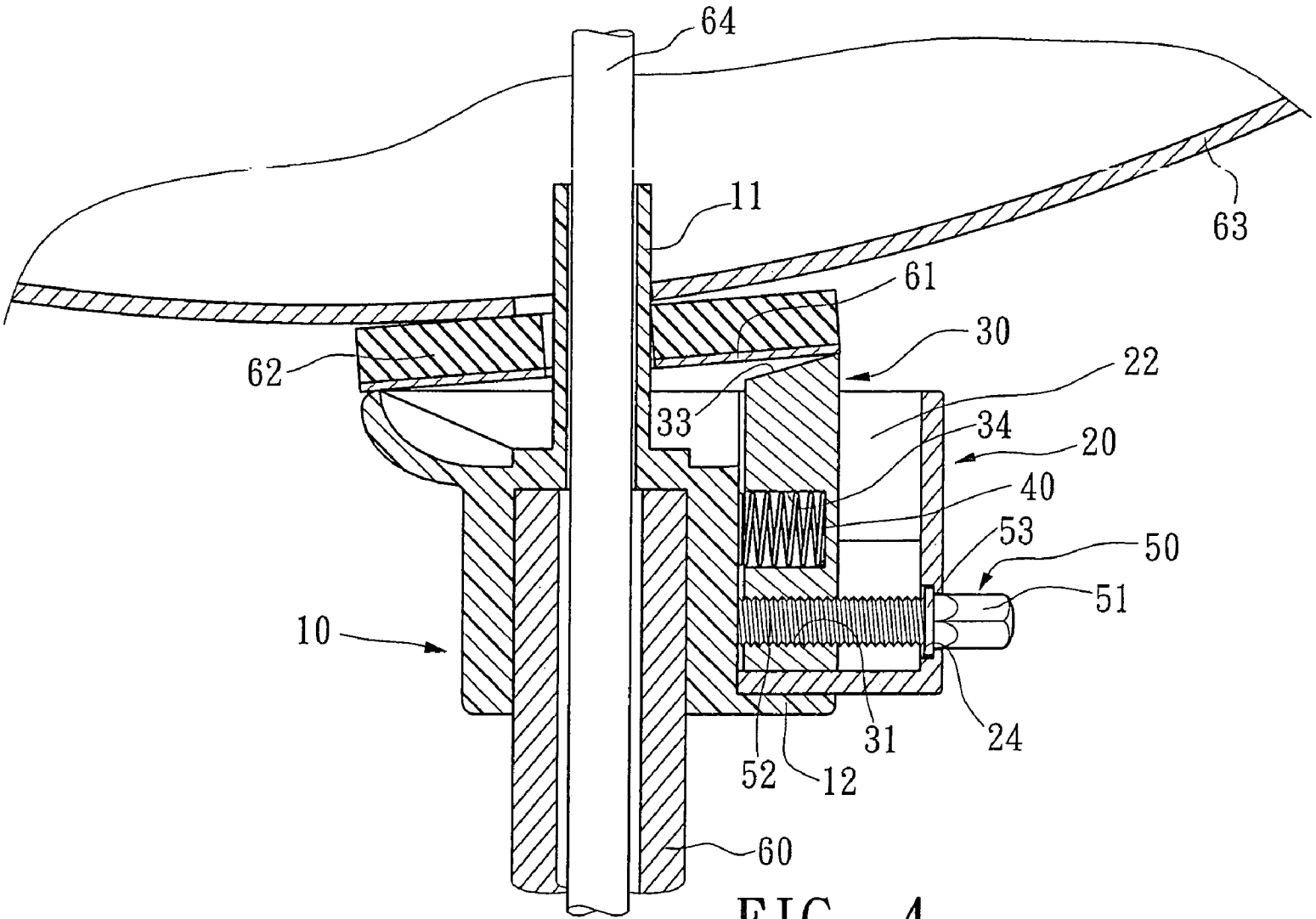
FIG. 4 is a side operational plan view in cross-section of the angle adjust device in FIG. 2 when the slider is inwardly moved to lift the cymbal.

With reference to FIGS. 2 and 4, the slider (30) is moved toward the connecting seat (10) to increase an angle of elevation of the cushion pad (62) and the cymbal (63) due to the tapered plane (33) of the slider (30) when rotating the actuated rod (50). On the contrary, the angle of elevation of the cushion pad (62) and the cymbal (63) is decreased when the slider (30) is moved opposite to the connecting seat (10).

Figure 5:
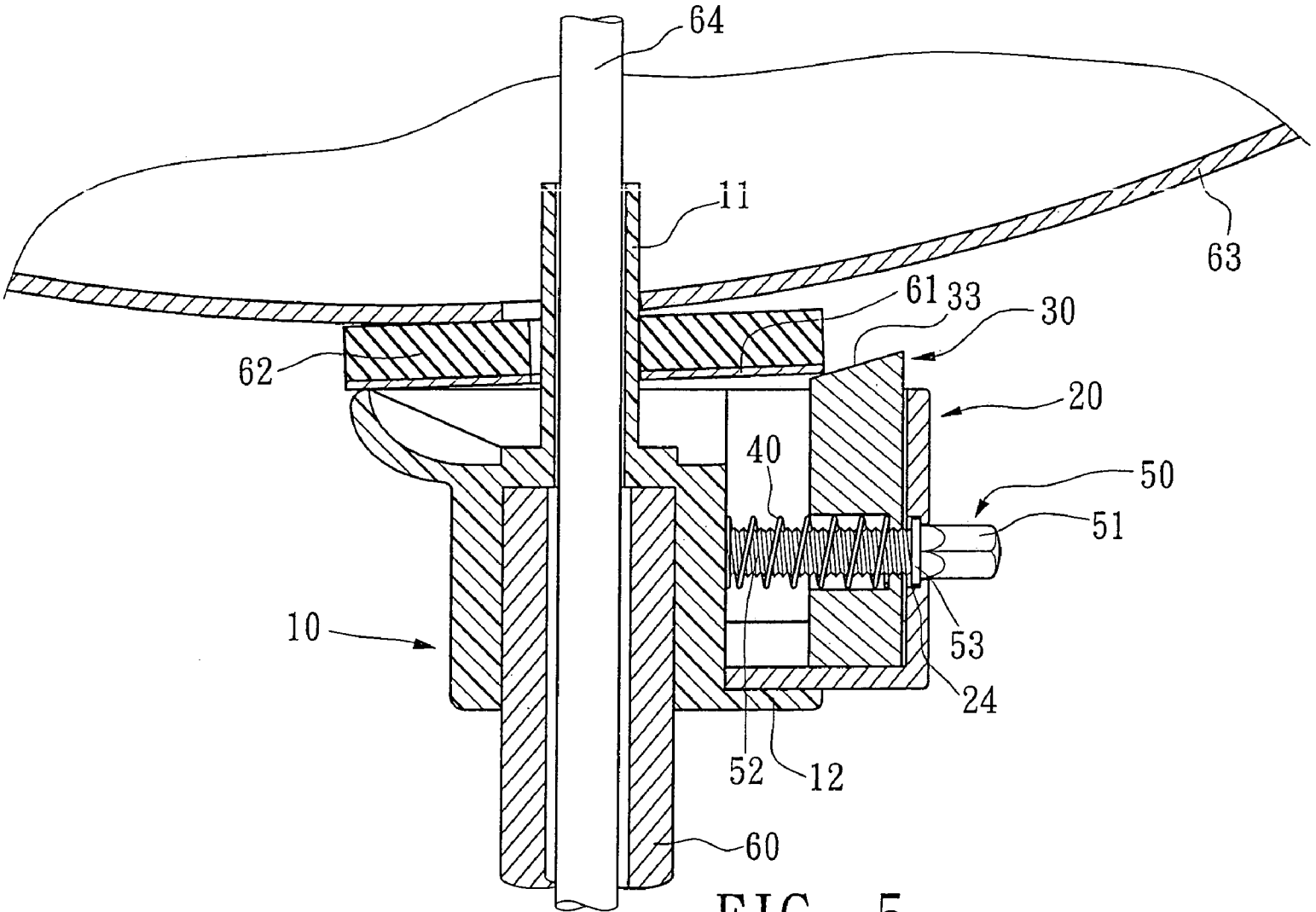
FIG. 5 is a side operational plan view in cross-section of a second embodiment of an angle adjust device for a cymbal in accordance with the present invention when the slider is outwardly moved to reduce the angle between the cymbal and the level.
Figure 6:
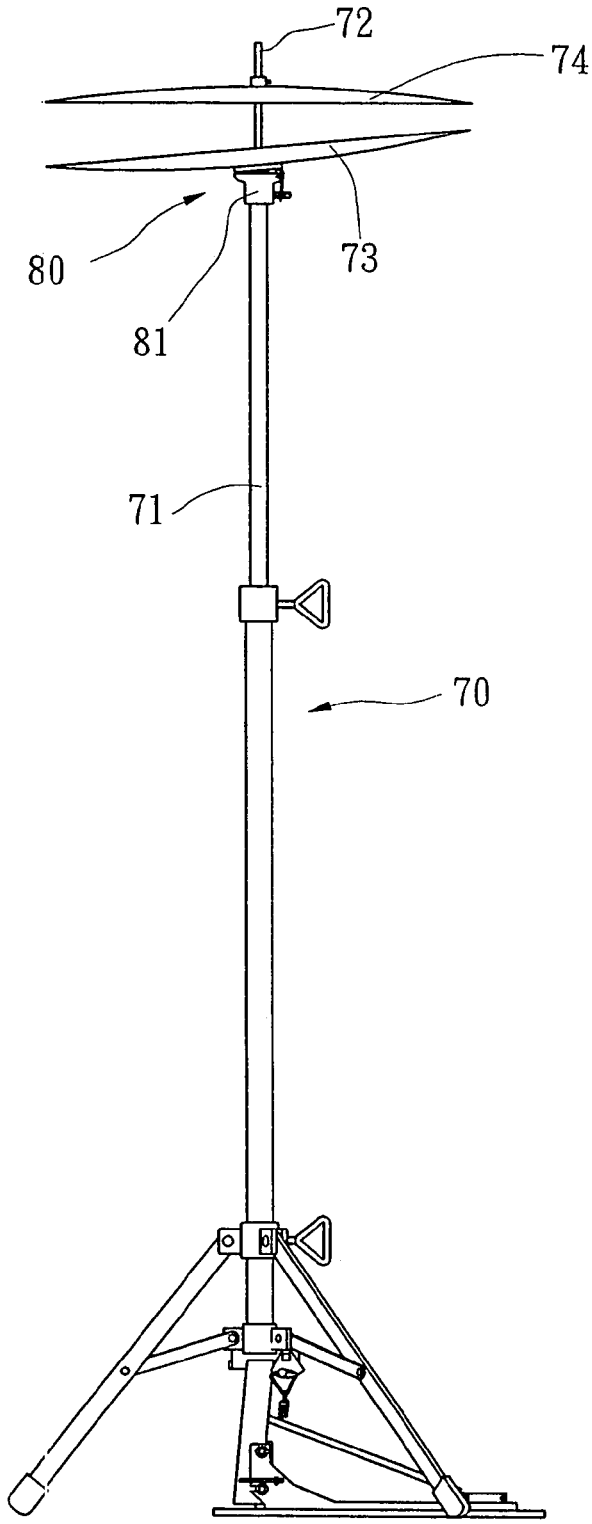
FIG. 6 PRIOR ART
FIG. 6 is a schematic plan view of a conventional angle adjust device for a cymbal in accordance with the prior art.
Figure 7:
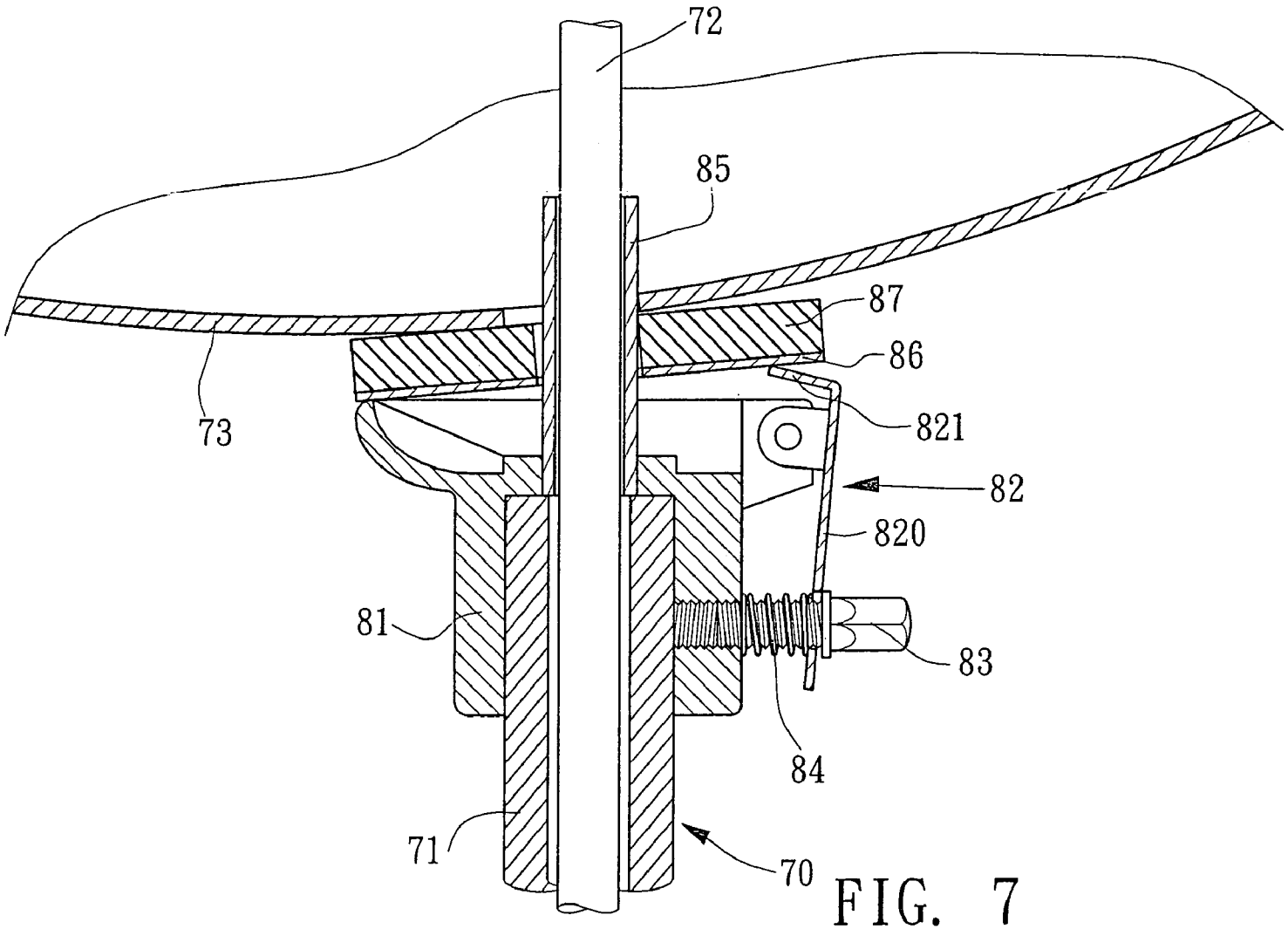
FIG. 7 PRIOR ART
FIG. 7 is an operational view in cross-section of the angle adjust device in FIG. 6.

With reference to FIG. 5, it is a second embodiment of the angle adjust device in accordance with the present invention. The threaded hole (31) in the slider (30) communicates with the blind hole (34) and co-axially corresponds to the through hole (24) in the connector (20) so that the actuated rod (50) extends through the resilient member (40).

As described above, the angle adjust device for a cymbal in accordance with the present invention includes the following advantages.

1. The connector (20), the slider (30), the resilient member (40) and the actuated rod (50) are previously assembled and mounted to the connecting seat (10) so that the assembling processes of the present invention is simplified.

2. The connector (20) is buckled to the connecting seat (10) for increasing the connecting area and the hollow stub (1) is integrally formed with the connecting seat (10) so that the angle adjust device of the present invention has a good connection.

3. The slider (30), the resilient member (40) and the actuated rod (50) are received in the trough (22) in the connector (20) so that the angle adjust device of the present invention has a complete appearance and an effect of dust-proof.

Although the invention has been explained in relation to its preferred embodiment, it is to be understood that many other possible modifications and variations can be made without departing from the spirit and scope of the invention as hereinafter claimed.

What is claimed is:

1. An angle adjust device for a cymbal, comprising:

a connecting seat adapted to be mounted to a free end of a cymbal stand, said connecting seat including a hollow stub longitudinally extending through said connecting seat and a protrusion laterally extending from said connecting seat;

a connector mounted to said protrusion of said connecting seat and having a trough defined in said connector, said trough in said connector having an opening defined in one side of said connector facing said connecting seat;

a slider movably received in said trough in said connector; and an actuated rod disposed in said connector, said actuated rod having a threaded section screwed into said threaded hole in said slider and a polygonal head co-axially extending from said threaded section through said connector for a user to easily rotate said actuated rod and adjust a distance between said slider and said connecting seat.

2. The angle adjust device as claimed in claim 1, wherein a tapered plane is formed on a top portion of said slider, said tapered plane having a height gradually reduced relative to said connecting seat.

3. The angle adjust device as claimed in claim 1, wherein said protrusion is U-shaped and has two rails respectively inwardly extending from two opposite sides of said protrusion to define two grooves in said two opposite sides of said protrusion, said connector having two flanges outwardly extending from two opposite sides thereof and each flange respectively inserted into a corresponding one of said two grooves in said protrusion to hold said connector in place between said two rails.

4. The angle adjust device as claimed in claim 2, wherein said protrusion is U-shaped and has two rails respectively inwardly extending from two opposite sides of said protrusion to define two grooves in said two opposite sides of said protrusion, said connector having two flanges outwardly extending from two opposite sides thereof and each flange being respectively inserted into a corresponding one of said two grooves in said protrusion to hold said connector in place between said two rails.

5. The angle adjust device as claimed in claim 1, wherein said connector comprises two guiders laterally inwardly extending from two opposite sidewalls of said trough in said connector and said slider comprises two grooves respectively defined in two opposite sides of said slider, each groove in said slider receiving a corresponding one of said two guiders of said connector to limit a moving direction of said slider.

6. The angle adjust device as claimed in claim 1, wherein said connector comprises a through hole defined in a back thereof and co-axially corresponding to said threaded hole in said slider, an annular lip extending from an inner periphery of said through hole in said connector, said actuated rod having a shoulder radially extending therefrom between said threaded section and said polygonal head and abutting the of the connector to limited said actuated rod in said connector.

7. The angle adjust device as claimed in claim 1 further comprising a resilient member mounted between said slider and said connecting seat for ensure said actuated rod limited in said connector.

8. The angle adjust device as claimed in claim 7, wherein said slider comprises a blind hole defined therein and extending toward said connecting seat for partially receiving said resilient member.

9. The angle adjust device as claimed in claim 8, wherein said blind hole in said slider co-axially communicates with said threaded hole in said slider so that said actuated rod extends through said resilient member.

10. The angle adjust device as claimed in claim 7, wherein said resilient member is a coil spring.

11. The angle adjust device as claimed in claim 8, wherein said resilient member is a coil spring.

12. The angle adjust device as claimed in claim 9, wherein said resilient member is a coil spring.

* * * * *